US010190401B2

(12) United States Patent
Hansen et al.

(10) Patent No.: US 10,190,401 B2
(45) Date of Patent: Jan. 29, 2019

(54) METHOD FOR THE STIMULATION OF THE NEAR-WELLBORE RESERVOIR OF A HORIZONTAL WELLBORE

(71) Applicant: Total E&P Danmark A/S, Kobenhavn Ø (DK)

(72) Inventors: Jens Henrik Hansen, Doha (QA); Sreejith Pulloor Kuttanikkad, Doha (QA)

(73) Assignee: Total E&P Danmark A/S, København Ø (DK)

( * ) Notice: Subject to any disclaimer, the term of this patent is extended or adjusted under 35 U.S.C. 154(b) by 0 days.

(21) Appl. No.: 15/312,371

(22) PCT Filed: May 20, 2015

(86) PCT No.: PCT/EP2015/061090
§ 371 (c)(1),
(2) Date: Nov. 18, 2016

(87) PCT Pub. No.: WO2015/177199
PCT Pub. Date: Nov. 26, 2015

(65) Prior Publication Data
US 2017/0138161 A1 May 18, 2017

(30) Foreign Application Priority Data
May 20, 2014 (GB) ..... 1408900.7

(51) Int. Cl.
*E21B 43/25* (2006.01)
*E21B 43/08* (2006.01)
(Continued)

(52) U.S. Cl.
CPC ..... *E21B 43/25* (2013.01); *E21B 33/12* (2013.01); *E21B 33/122* (2013.01); *E21B 34/06* (2013.01); *E21B 43/08* (2013.01); *E21B 43/14* (2013.01)

(58) Field of Classification Search
None
See application file for complete search history.

(56) References Cited

U.S. PATENT DOCUMENTS 5,197,543 A * 3/1993 Coulter ..... E21B 33/13 166/281
5,697,441 A * 12/1997 Vercaemer ..... E21B 33/124 166/285
(Continued)

FOREIGN PATENT DOCUMENTS

EP 1184537 B1 11/2005
EP 2607607 A1 6/2013
(Continued)

OTHER PUBLICATIONS

Hansen et al., "Controlled Acid Jet (CAJ) Technique for Effective Single Operation Stimulation of 14,1000+ft Long Reservoir Sections", presented Oct. 2002.
(Continued)

*Primary Examiner* — Anuradha Ahuja
(74) *Attorney, Agent, or Firm* — Brinks Gilson & Lione

(57) ABSTRACT

A wellbore (1) surrounded by a formation has a horizontal section provided with a non-cemented perforated liner (3), thereby forming an annular space (4) between the liner and the formation. The annular space is divided into zones (zone 1, zone 2, zone 3) isolated from each other by means of respective external packers (6, 7, 8) arranged externally on the liner. Selective access to the zones is provided by means of an internal pipe (9) arranged inside the liner and provided with internal packers (10, 11, 12) corresponding to the
(Continued)

Figure 1A:
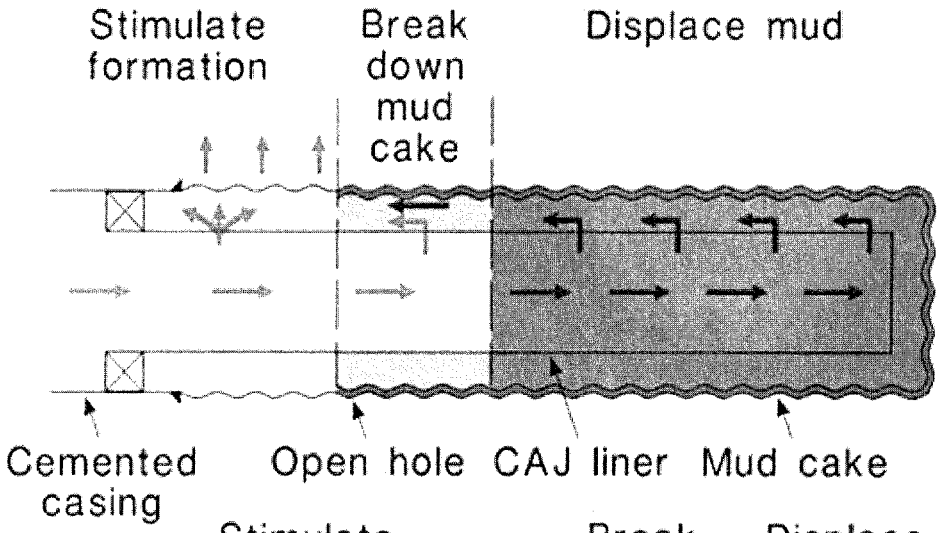
Fig. 1a PRIOR ART

respective external packers. For each of the zones, the internal pipe is provided with a valve (14, 15, 16) providing access between the inside of the internal pipe and the corresponding zone. Stimulation of the near-wellbore is performed by pumping acid or the like reactive fluid through the internal pipe into the wellbore and is performed simultaneously in adjacent zones of the annular space.

20 Claims, 4 Drawing Sheets

(51) Int. Cl.

| | |
|---|---|
| ***E21B 43/14*** | (2006.01) |
| ***E21B 34/06*** | (2006.01) |
| ***E21B 33/12*** | (2006.01) |
| ***E21B 33/122*** | (2006.01) |

(56) References Cited

U.S. PATENT DOCUMENTS

| | | | | |
|---|---|---|---|---|
| 5,715,891 | A * | 2/1998 | Graham | E21B 7/061 166/117.6 |
| 5,934,376 | A * | 8/1999 | Nguyen | E21B 43/025 166/227 |
| 6,047,773 | A * | 4/2000 | Zeltmann | E21B 21/14 166/281 |
| 6,766,858 | B2 * | 7/2004 | Nguyen | E21B 33/138 166/292 |
| 7,441,596 | B2 * | 10/2008 | Wood | E21B 33/1208 166/179 |
| 7,458,423 | B2 * | 12/2008 | Vercaemer | E21B 33/13 166/227 |
| 8,443,892 | B2 * | 5/2013 | Richard | E21B 33/1208 166/177.5 |
| 9,187,977 | B2 * | 11/2015 | Alvarez | E21B 33/1208 |
| 2003/0034160 | A1 * | 2/2003 | Nguyen | E21B 43/045 166/278 |
| 2005/0072567 | A1 * | 4/2005 | Steele | E21B 43/2406 166/272.3 |
| 2008/0210422 | A1 | 9/2008 | Clark et al. | |
| 2009/0090502 | A1 | 4/2009 | Lumbye et al. | |
| 2009/0114385 | A1 * | 5/2009 | Lumbye | E21B 43/28 166/250.01 |
| 2009/0139728 | A1 * | 6/2009 | Schrader | E21B 34/10 166/373 |
| 2009/0218101 | A1 | 9/2009 | Langlais et al. | |
| 2009/0294128 | A1 * | 12/2009 | Dale | E21B 33/127 166/306 |
| 2010/0326656 | A1 * | 12/2010 | Menard | E21B 43/086 166/272.3 |
| 2013/0062072 | A1 * | 3/2013 | Alvarez | E21B 33/1208 166/376 |
| 2014/0083689 | A1 | 3/2014 | Streich et al. | |

FOREIGN PATENT DOCUMENTS

| | | | |
|---|---|---|---|
| EP | 2446107 | B1 | 7/2013 |
| WO | 2007134598 | A1 | 11/2007 |
| WO | 2010051301 | A1 | 5/2010 |
| WO | 2012011994 | A1 | 1/2012 |
| WO | 2013089897 | A2 | 6/2013 |
| WO | 2013182635 | A1 | 12/2013 |
| WO | 2014022611 | A1 | 2/2014 |
| WO | 2014114510 | A2 | 7/2014 |

OTHER PUBLICATIONS

Mogensen et al., "A Dynamic Model for High-Rate Acid Stimulation of Very Long Horizontal wells", Presented Nov. 11, 2007.

Sasonkgo, "Acid Placement in Acid Jetting Treatments in Long Horizontal Wells", May 1, 2012.

Hazel et al., "Open Hole Packers Provide Zonal Isolation for High Pressure Acid Stimulation Within a Chalk Reservoir", Presented Sep. 30, 2013.

Kent et al., "Intelligent Completions and Un-cemented Liners Combine to Provde a Fully Completed Solution with Zonal Isolation in Norway", Presented Sep. 30, 2013.

Search Report for Great Britain Application No. GB1408900.7, dated Nov. 18, 2014.

International Search Report and Written Opinion for PCT/EP2015/061090, dated Nov. 26, 2015.

International Preliminary Report on Patentability for PCT/EP2015/061090, dated Nov. 22, 2016.

* cited by examiner

PRIOR ART

METHOD FOR THE STIMULATION OF THE NEAR-WELLBORE RESERVOIR OF A HORIZONTAL WELLBORE

RELATED APPLICATIONS

This application claims the benefit under 35 U.S.C. § 371 of the filing date of International Patent Application No. PCT/EP2015/061090, having an international filing date of May 20, 2015, which claims priority to Great Britain Application No. 1408900.7, filed May 20, 2014, the contents of both of which are incorporated herein by reference in their entirety.

The present invention relates to a method for stimulation of the near-wellbore reservoir of a wellbore surrounded by a formation in a subterranean hydro-carbon reservoir, the wellbore having a horizontal section including a heel section and a toe section, the horizontal section being provided with a non-cemented perforated liner being perforated by means of holes possibly provided with valves, thereby forming an at least substantially annular space between the non-cemented perforated liner and the formation, the liner having a perforation pattern being optimized for stimulation of the near-wellbore so that the total hole area per unit length of the liner varies over the length of the liner from the heel to the toe, the at least substantially annular space between the non-cemented perforated liner and the formation being divided into at least two zones isolated from each other by means of one or more external packers arranged externally on the non-cemented perforated liner, whereby selective access to the at least two zones is provided by means of an internal pipe arranged inside the non-cemented perforated liner and provided with one or more internal packers corresponding to the one or more external packers and sealing an at least substantially annular space between the internal pipe and the non-cemented perforated liner, whereby, for each of the zones, the internal pipe is provided with a valve providing access between the inside of the internal pipe and the corresponding zone, and whereby stimulation of the near-wellbore is performed by pumping acid or the like reactive fluid through the internal pipe into the wellbore.

EP 1 184 537 B1 (Maersk Olie og Gas NS) discloses a method of stimulating a wellbore, wherein acid or the like reactive fluid is supplied for decomposing material in the near wellbore formation by use of a liner arranged within the wellbore while forming a space between the liner and the formation of the wellbore, said supplied liquid being discharged to said space through holes formed in the wall of the liner in the longitudinal expanse of the liner for influencing the formation of the wellbore. Such a liner may subsequently to acid stimulation be used for water, gas or steam injection or for oil, gas or water production. This type of liner is a so-called Controlled Acid Jet (CAJ) liner. The CAJ liner concept and functionality is further described in SPE 78318 and SPE 110135.

The CAJ liner will typically have a perforation pattern being optimized for acid stimulation of the near-wellbore so that the total hole area per unit length of the liner varies over the length of the liner from the heel (the inner part of the wellbore) to the toe (the outer part of the wellbore). When used for single-operation stimulation of long horizontal reservoir sections, typically, the total hole area per unit length of the liner increases over the length of the liner from the heel to the toe. This perforation pattern will in particular be adapted to counteract the rather large friction pressure loss over the length of the wellbore during acid stimulation so that the formation is treated more or less equally independently of the position along the wellbore.

The advantages of the CAJ liner are low installation costs, fast installation, rig-less stimulation, safer perforation (no guns), increased productivity/injectivity, easy re-stimulation etc. The main disadvantage of the CAJ liner in its original form is the lack of zonal isolation/zonal control required to handle fractures or high permeability contrasts along the reservoir section.

Recent attempts aiming at developing zonal completions based on the CAJ liner principle are described in EP 2 446 107 B1 (MAERSK OLIE OG GAS NS), SPE 166209 (CoP) and SPE 166391 (Welltec). This would combine the superior productivity and lower installation cost of the CAJ liner with the reservoir management options of the less productive and more expensive conventional cemented and perforated liners without zonal control. These new concepts are based on open hole external casing packers for zonal isolation combined with packers run on an inner pipe with sliding sleeves or valves for selective zone access.

Various methods have been developed to allow sequential stimulation and selective zonal control for these multiple CAJ liner completed wells. Most recent methods rely on surface controlled sliding sleeves or valves activated by tools deployed on coiled tubing or wireline deployed tractors.

A common problem observed and reported in the literature is the formation of zonal communication between the zones behind the packers due to worm-holes formed in the formation. Once formed, these connections are very difficult and expensive to repair and most likely will be left unrepaired causing loss of reservoir management options initially planned for.

Additional attempts to maintain packer integrity/functionality during and after the stimulation jobs include leaving some 200 to 400 ft tubing on both sides of the packer blank (non-perforated) in order to prevent the acid from forming wormholes near the packer. However, success of this method would depend on the condition of the mud (must be stimulated immediately after installation, while the mud cake is still efficient), the type of the mud (acid insoluble or acid soluble) and time required for swell packers to gain full pressure integrity (depending on reservoir fluids and nature of elastomers this is very uncertain and may take from days to months). An additional effort includes reduction of the average acid coverage pumped but this solution will reduce the length of the wormholes and limit the stimulation of the distant part of the well incomplete, hence providing a less efficient stimulation job.

Despite the many efforts to maintain zonal integrity past the stimulation job, none has so far proved a high probability of success despite the increased cost, increased time, reduced productivity, and reduced recovery fraction associated with the attempts.

SPE 166391 reports the observation that contact between adjacent non-cemented zones (corresponding to CAJ liner zones, but not referred to as such) most often occurs to a zone, which has previously been stimulated, hence the first stimulation would not generate a direct communication. In the paper this observation is attributed to the length of the wormholes generated during the stimulation job and that wormholes initiated from either side of the packer connects in the reservoir. Possible mitigation could be longer packers, dual packers with larger spacing, decreased acid coverage, and/or blank (non-perforated) pipe sections just above and below the sealing part of the packer element.

The object of the present invention is to provide a method for stimulation of the near-wellbore reservoir of a wellbore as mentioned in the introduction, whereby zonal integrity during stimulation of the near-wellbore is substantially maintained during and after the stimulation procedure.

In view of this object, stimulation of the near-wellbore is performed simultaneously in all or at least two adjacent zones of the at least substantially annular space between the non-cemented perforated liner and the formation.

Thereby, the pressure profiles along the length of the wellbore may develop to create a no-flow boundary at the packer between the adjacent zones hence forcing the wormholes to grow radially away from the wellbore. Since the pressure profile develops much faster than the wormholes created by the reactive transport of the hydrochloric acid or the like reactive fluid it may be possible to establish the optimum streamlines before the wormholes connect to the neighbouring zone.

In an embodiment, pressure differences occurring during stimulation of the near-wellbore between adjacent zones of the at least substantially annular space between the non-cemented perforated liner and the formation are at least substantially reduced by designing the perforation scheme of the non-cemented perforated liner, in particular the variation of the hole area per unit length, over the length of the liner, in accordance with information on zonal reservoir pressure and preferably in accordance with completion details of the wellbore. Thereby, the probability of maintaining zonal integrity during stimulation of the near-wellbore may be increased.

In an embodiment, pressure differences occurring during stimulation of the near-wellbore between adjacent zones of the at least substantially annular space between the non-cemented perforated liner and the formation are at least substantially reduced by accordingly controlling the pumping rates of acid or the like reactive fluid and possibly the pumping rates of water through the internal pipe into the wellbore. Thereby, a no-flow boundary may be created in the reservoir between the zones hence favouring radial growth of the wormholes and consequently even further improving zonal integrity during stimulation of the near-wellbore.

In an embodiment, stimulation is initiated at least substantially simultaneously in all zones of the at least substantially annular space between the non-cemented perforated liner and the formation, preferably by opening the respective valves of the internal pipe at least substantially simultaneously. Thereby, it may be avoided that a previously stimulated neighbouring zone causes the at least substantially annular space to act as an efficient conduit making the pressure gradient between the neighbouring zones even larger so that wormholes are more likely to grow to connect the two zones.

In an embodiment, initially, before performing stimulation of the near-wellbore simultaneously in adjacent zones of the at least substantially annular space between the non-cemented perforated liner and the formation, acid or the like reactive fluid is pumped into only one zone at a time, by opening the valve of the internal pipe corresponding to said one zone and closing the valves corresponding to the remaining zones, until mud is at least substantially displaced from the entire internal pipe. Thereby, the subsequent stimulation may be improved in that the acid may better reach all zones at the designed rate and volume, and, during stimulation, pressure differences between adjacent zones of the at least substantially annular space between the non-cemented perforated liner and the formation may be at least substantially reduced.

In an embodiment, before performing stimulation of the near-wellbore simultaneously in adjacent zones of the at least substantially annular space between the non-cemented perforated liner and the formation, acid or the like reactive fluid is firstly pumped into only the innermost one zone nearest the heel section and secondly pumped into only the outermost one zone nearest the toe section. In this way, mud may in an efficient way be displaced from the entire internal pipe. Firstly, the mud may be displaced from the wellbore section before the heel, and secondly, mud may be displaced from the wellbore section between the heel and the toe. Similarly, acid or the like reactive fluid may be pumped stepwise into a sequence of zones starting in a zone near the heel and ending in a zone near the toe.

In an embodiment, said initial pumping of acid or the like reactive fluid into only said one zone at a time is performed at an initial pump rate that is at least substantially lower than, preferably lower than ½ of, more preferred lower than ¼ of, and most preferred lower than ⅙ of, the average pump rate during the subsequent stimulation. Thereby, it may be avoided that an actual acid stimulation with substantial formation of wormholes or induced fracture(s) is taking place in said one zone during said initial pumping of acid. Thereby, it may be avoided that wormholes or fracture(s) may grow to connect the outermost zone with its neighbouring zone when the neighbouring zone is subsequently stimulated.

In an embodiment, stimulation at said average pump rate is initiated at least substantially simultaneously in all zones of the at least substantially annular space between the non-cemented perforated liner and the formation, preferably by opening the respective valves of the internal pipe at least substantially simultaneously, after said initial pumping of acid or the like reactive fluid at said initial pump rate into said one zone at a time. Thereby, it may to a large extent be avoided that a previously stimulated neighbouring zone causes the at least substantially annular space to act as an efficient conduit making the pressure gradient between the neighbouring zones even larger so that wormholes may grow to connect the two zones.

In an embodiment, a desired reservoir pressure profile along the length of the wellbore is established before stimulation is initiated by pumping water or a fluid of at least substantially reduced reactivity compared to the acid or reactive fluid used during stimulation through the internal pipe into all zones of the at least substantially annular space between the non-cemented perforated liner and the formation. Thereby, it may, during stimulation, to an even larger extent be avoided that a previously stimulated neighbouring zone causes the at least substantially annular space to act as an efficient conduit making the pressure gradient between the neighbouring zones even larger so that wormholes may preferentially grow to connect the two neighbouring zones. This may be obtained because pressure differences between adjacent zones of the at least substantially annular space between the non-cemented perforated liner and the formation may to a large extent be reduced even before any acid or the like reactive fluid enters the zones.

In an embodiment, the non-cemented perforated liner includes a non-perforated section at either side of each external packer. Thereby, the volume of reactive fluid being injected into the formation very near to the packer may be limited, thereby further maintaining the zonal integrity during stimulation.

In an embodiment, the concentration of the acid or the like reactive fluid and/or the pump rate is changed during stimulation. Thereby, the pressure profile and direction of wormhole growth around the packer may be further controlled.

Figure 1B:
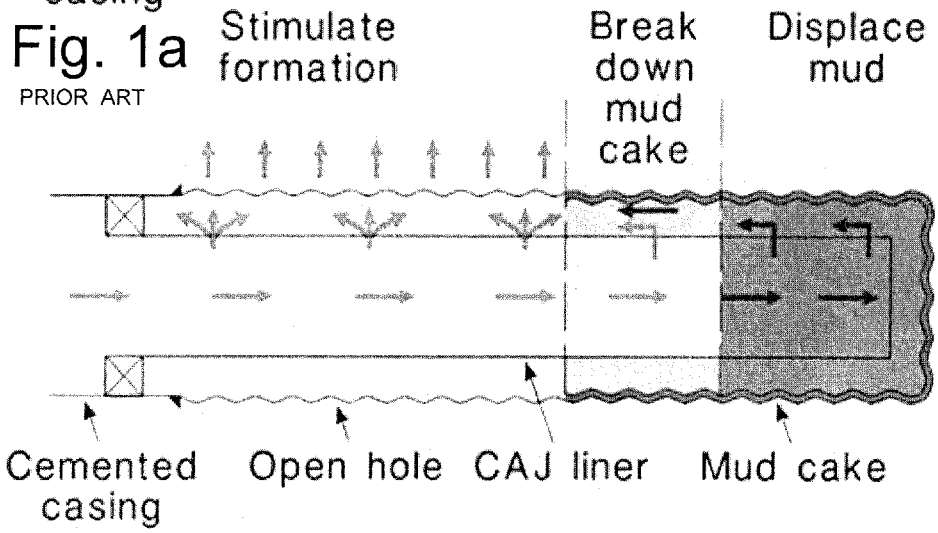
Fig. 1b PRIOR ART
Figure 1C:
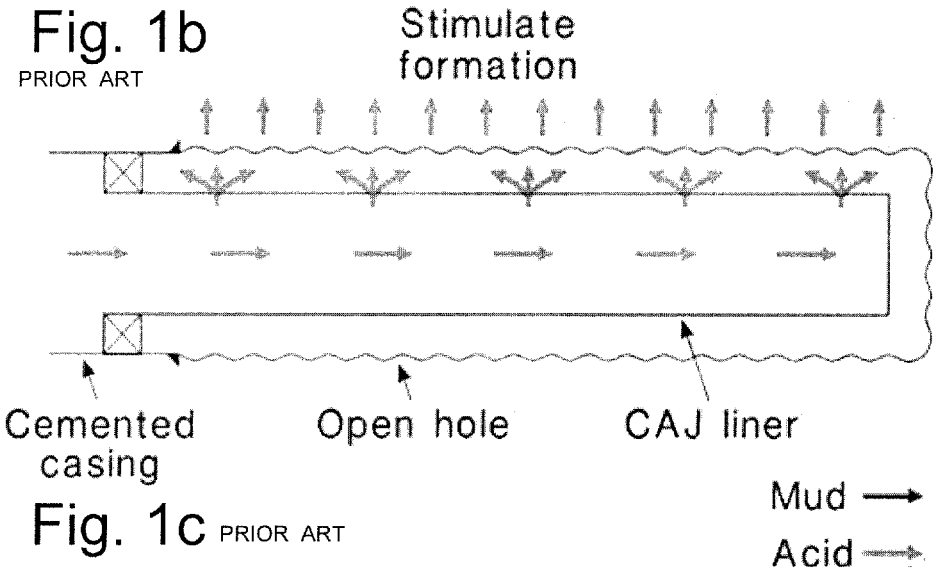
Fig. 1c PRIOR ART
Figure 2:
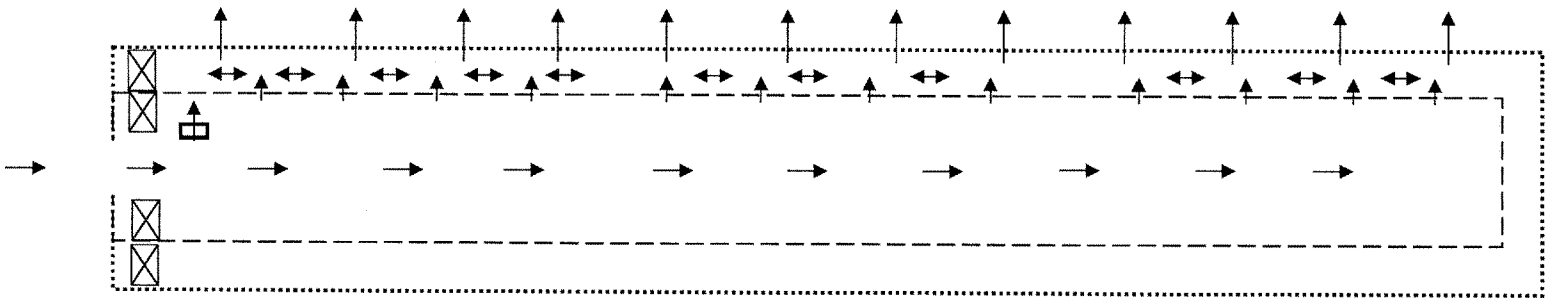
Figure 3A:
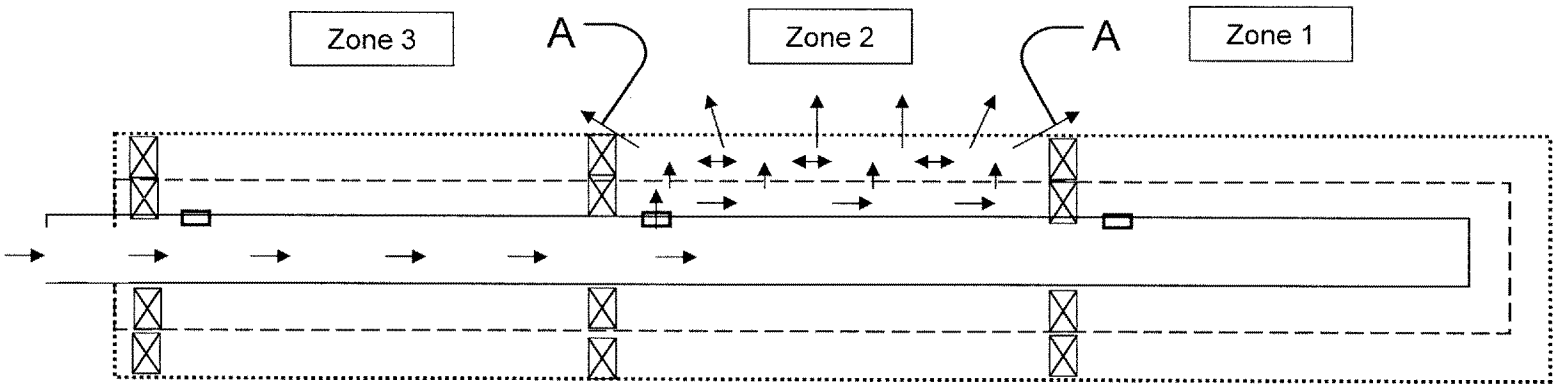
Fig. 3a PRIOR ART
Figure 3B:
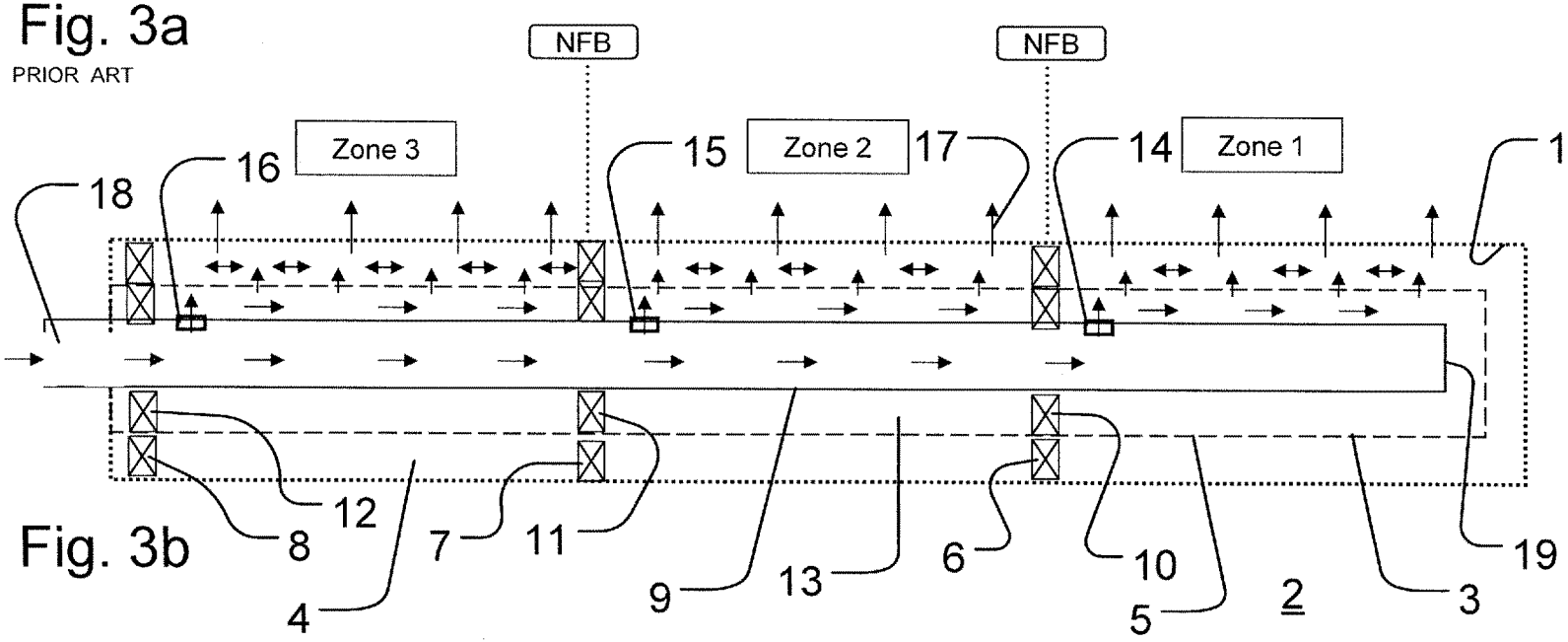
Figure 4A:
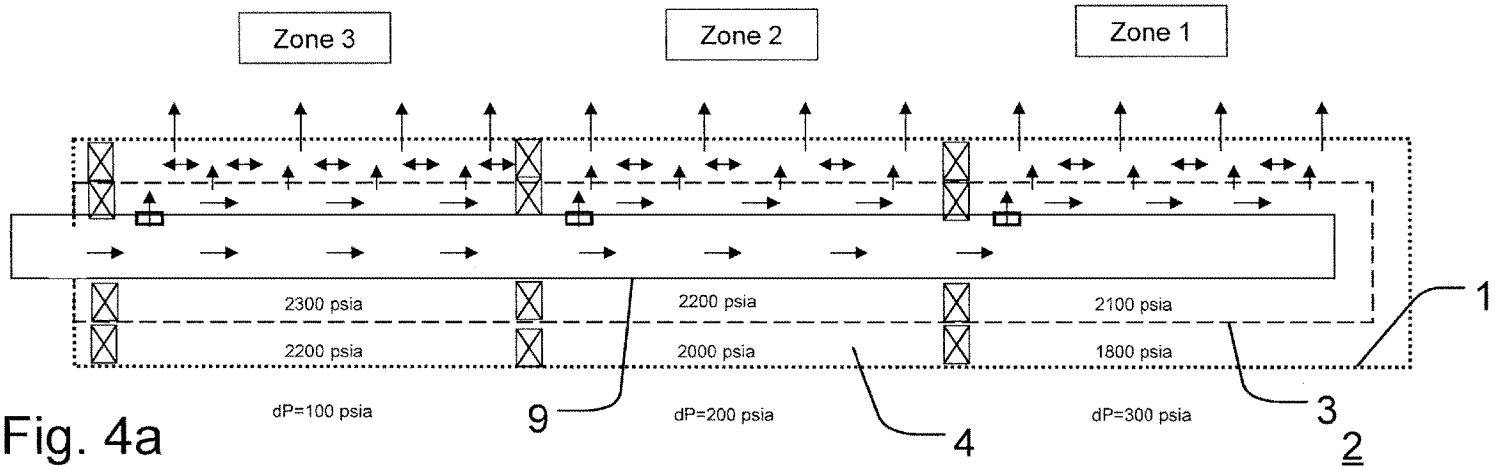
Figure 4B:
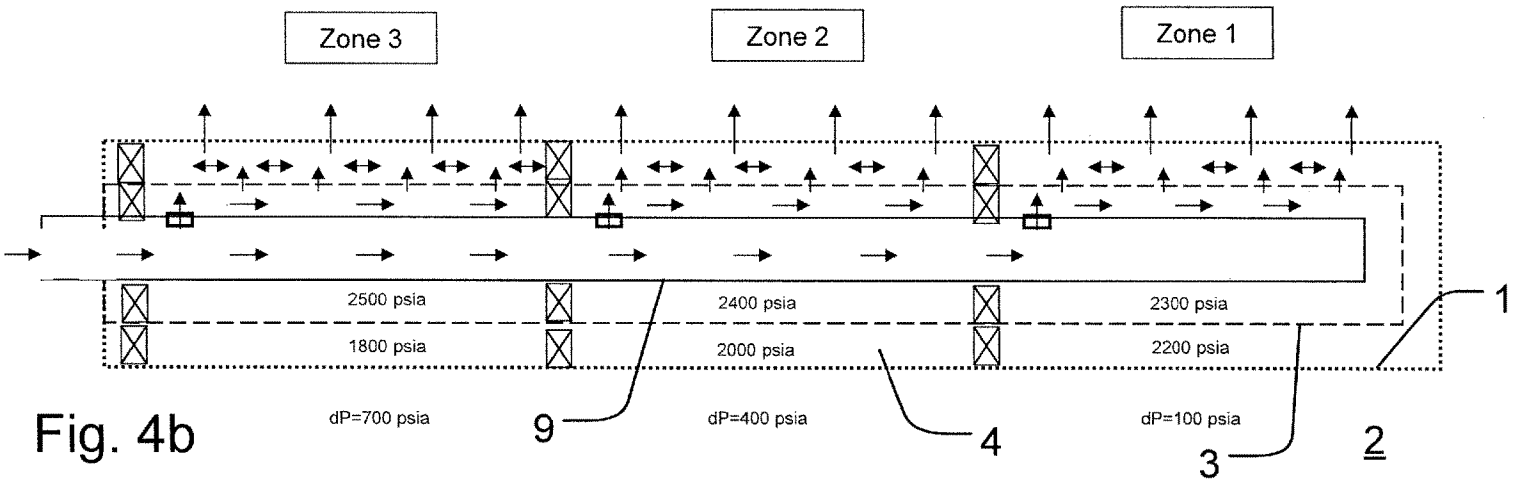

The invention will now be explained in more detail below by means of examples of embodiments with reference to the very schematic drawing, in which FIGS. 1*a*, 1*b* and 1*c* show axial sections through a wellbore illustrating prior art single-operation stimulation by means of a CAJ liner;

FIG. 2 shows an axial section through a wellbore illustrating prior art stimulation of wellbores completed with a single CAJ liner zone;

FIG. 3*a* is an axial section through a wellbore illustrating wormhole formation during prior art stimulation of wellbores completed with multiple CAJ liner zones;

FIG. 3*b* is an axial section through a wellbore illustrating wormhole formation during stimulation according to the invention of wellbores completed with the shown system including an internal pipe, packers and multiple CAJ liner zones, whereby a no-flow boundary is created between the zones; and FIGS. 4*a* and 4*b* are axial sections through a wellbore corresponding to FIG. 3*b*, illustrating two specific examples of pressure distribution during stimulation of a wellbore according to the invention.

Effective development of low-permeability carbonate reservoirs requires efficient well stimulation, and obtaining a predefined (often uniform) acid stimulation along an entire 10,000-20,000 ft reservoir section of a horizontal well is a challenge.

The Controlled Acid Jet (CAJ) liner described above, provides a technology for single-operation stimulation of an ultra-long horizontal reservoir section. The CAJ technique has, in several ways, set new standards for the completion and stimulation of long horizontal wells; its most significant achievement being the remarkably effective acid coverage and achieved stimulation efficiency resulting from stimulation of long reservoir sections in a single operation.

Successful implementation of the CAJ technique requires numerical modelling of the dynamics of the entire stimulation process to ensure the best possible distribution of the acid, effective control of the wormhole growth rate in multiple sections of the well, displacement of mud along the entire reservoir section, handling formation pressure gradients along the reservoir section, and many other complicating factors.

The main idea behind the known CAJ liner is illustrated in FIGS. 1*a* to 1*c*. The open annulus (an at least substantially annular space between the non-cemented perforated liner and the formation) and the small number of optimized perforations provide the conditions required to circulate the mud in the liner and obtain the required effective acid distribution along the well. The flow distribution along the CAJ liner is outlined in FIGS. 1*a* to 1*c*. Initially, both the liner and liner well bore annulus are filled with mud, as illustrated in FIG. 1*a*. Also, a high resistance to flow exists at the well bore face (mud cake). When the first acid hits the formation on the top of the liner, the mud cake and formation will break down and considerable volumes start leaking off to the formation. Hence, as soon as an effective connection to the reservoir has been established, the stimulation pressure will fall, assuming constant stimulation rates. At this stage of the stimulation job, the fluid leak-off into the top of the reservoir section is a mixture of acid jetting out of the predrilled liner holes in the top section of the CAJ liner and fluids flowing from the more distant part of the liner annulus in the direction of the heel. As the acid front moves along the liner, a break down zone is created, where acid mixes with the mud and breaks down the mud and the mud cake.

The CAJ liner may be provided with its perforation pattern by drilling the holes in the liner at surface. Furthermore, the holes may be provided with valves, such as for instance one way valves or any other suitable valve adapted for control of the fluid communication between the inside and the outside of the liner.

Eventually, when all mud is broken down and residual displaced into the formation, the annulus will be fully filled with acid, as illustrated in FIG. 1*c*. There will continue to be a net flow towards the sections with the lowest skin in the well, and the acid flowing towards these sections will wash the well bore face. Fresh acid will continue to be jetted at the predetermined distribution points along the CAJ liner, ensuring effective stimulation along the full liner length by acid flow in the annulus.

The concept and the flow paths of the prior art original single zone CAJ liner are further illustrated in FIG. 2.

However, according to the prior art methods, stimulation in multi-CAJ liner completed zones is performed separately in one zone after another. The result of this procedure is illustrated in FIG. 3*a*, wherein zone 2 is being stimulated individually. Especially in the case that one of the neighbouring zones 1 or 3 has previously been stimulated, the open annulus (the at least substantially annular space between the non-cemented perforated liner and the formation) will act as a very efficient conduit most likely making the pressure gradient between the two adjacent zones even larger. Hence the wormholes will preferably grow to connect the two zones as illustrated by the oblique arrows A at the external packers in FIG. 3*a*.

According to the present invention, on the contrary, the adjacent CAJ liner zones are stimulated simultaneously, as illustrated in FIG. 3*b*.

FIG. 3*b* illustrates a method for stimulation of a wellbore 1 surrounded by a formation 2 in a subterranean hydrocarbon reservoir, the wellbore having a horizontal section including a heel section and a toe section. The heel section and the toe section are not illustrated in the figure, but it is understood that the toe section is to the right of the figure and the heel section is to the left in the figure. The horizontal section is provided with a system including a non-cemented perforated liner 3, thereby forming an at least substantially annular space 4 between the non-cemented perforated liner 3 and the formation 2. The liner 3 has a perforation pattern composed by holes 5 and being optimized for stimulation of the near-wellbore 1 so that the total hole area (total area of the perforations) per unit length of the liner 3 varies over the length of the liner from the heel to the toe. In one embodiment of a system as described herein for practising the present method the zones 1, 2, 3 may have a length, such as about the same length, in the order of 500 ft-10,000 ft. In one possible embodiment of a system for practising the present method, explained for simplicity with reference to adjacent zones 1 and 2 shown in FIG. 3*b*, the total hole area per unit length for the part of the liner 3 in zone 2 increases from a minimum value at packer 7 to a maximum value at next packer 6 further downhole; the perforation pattern for the part of the liner 3 in zone 1 (which is closer to the toe section) may be selected such that the value of total hole area per unit length thereof at packer 6 is in the same order of magnitude as the aforementioned minimum value within zone 2, such as by way of example within a range of +/−10%, or such as by way of example within the range of +/−25%, depending on the well configuration, such as less than, preferably substantially less than, the aforementioned maximum value within zone 2. In other words, generally for such an embodiment the perforation pattern along the length of the liner 3 will repeat itself to some degree, with some adjustment due to the friction pressure drop between the zones, for all zones or at least for two adjacent zones 1, 2. Preferably, for such an embodiment of such a system the valves 14, 15, 16 of an internal pipe 9 to be discussed below are all located at the top of the respective zones 1, 2, 3 (seen from the heel section), leading to the advantage that the length of control wiring may be limited to the extent possible. For an alternative embodiment of a system for practising the method where valve 15 of zone 2 would be located at packer 6 (with valve 14 of adjacent zone 1 still being located at same packer 6 as shown in FIG. 3*b*) the perforation pattern may be such that the total hole area per unit length for zone 1 as well as zone 2 increases from a respective minimum value at packer 6 being of the same order of magnitude, by way of example within a variation of +/−10%, or such as by way of example within the range of +/−25%, again depending on the well configuration, to a maximum value at the opposite end of the respective zone, i.e. with the hole area per unit length increasing away from the common packer 6, along the length of the liner 3. For yet another embodiment the valves 14, 15, 16 may be placed halfway along the length of the respective zones 1, 2, 3 which may allow for a symmetric perforation pattern minimising the difference between minimum and maximum hole area per unit length in the zone(s). The said "unit length" may preferably be "feet". Depending on the friction pressure drop there may be a significant difference in the hole area per unit length, such as up to an order of magnitude difference in hole area per unit length between the top and the bottom of a given zone.

The at least substantially annular space 4 formed between the non-cemented perforated liner 3 and the formation 2 is divided into a number of zones of which zones 1, 2, 3 are illustrated. The number of zones may vary from two zones up to 10, 20 or even more than 50. The zones 1, 2, 3 are isolated from each other by means of respective external packers 6, 7, 8 arranged externally on the non-cemented perforated liner 3.

Selective access to the zones 1, 2, 3 is provided by means of an internal pipe 9 arranged inside the non-cemented perforated liner 3 and provided with internal packers 10, 11, 12 corresponding to the respective external packers 6, 7, 8 and sealing an at least substantially annular space 13 between the internal pipe 9 and the non-cemented perforated liner 3. The internal pipe 9 has inlet 18 indicated to the left in FIG. 3*b* at the heel section and has a closed end 19 at the right in the figure at the toe section. However, the non-cemented perforated liner 3 does not necessarily extend from the heel section to the toe section. For each of the zones 1, 2, 3, the internal pipe 9 is provided with a valve 14, 15, 16 providing access between the inside of the internal pipe 9 and the corresponding zone 1, 2, 3. Stimulation of the near-wellbore 1 is performed by pumping acid or the like reactive fluid through the internal pipe 9 into the wellbore 1.

According to the invention, the stimulation of the near-wellbore 1 is performed simultaneously in adjacent zones 1, 2, 3 of the at least substantially annular space 4 between the non-cemented perforated liner 3 and the formation 2. This is possible due to the extreme length coverage obtainable with the CAJ liner technique. Referring to FIG. 3*b*, by simultaneously pumping into adjacent zones 1, 2, 3, the pressure profiles may develop to create a no-flow boundary NFB between the zones 1, 2, 3 hence forcing the wormholes to grow radially away from the wellbore, as indicated by the arrows 17. Since the pressure profile develops much faster than the wormholes created by the reactive transport of the hydrochloric acid it may be possible to establish the optimum streamlines before the wormholes connect to the neighbouring zone 1, 2, 3.

During stimulation of the near-wellbore 1, pressure differences between adjacent zones 1, 2, 3 of the at least substantially annular space 4 between the non-cemented perforated liner 3 and the formation 2 may be at least substantially reduced by designing the perforation scheme of the non-cemented perforated liner 3 in accordance with information on zonal reservoir pressure and preferably in accordance with completion details of the wellbore 1.

Furthermore, during stimulation of the near-wellbore reservoir of the wellbore 1, pressure differences between adjacent zones 1, 2, 3 of the at least substantially annular space 4 may be at least substantially reduced by accordingly controlling the pumping rates of acid or the like reactive fluid and possibly water through the internal pipe 9 into the wellbore 1.

Stimulation may be initiated at least substantially simultaneously in all zones 1, 2, 3 of the at least substantially annular space 4 by opening the respective valves 14, 15, 16 of the internal pipe 9 at least substantially simultaneously. By initiating stimulation more or less simultaneously in all zones 1, 2, 3, it may even better be ensured that a no-flow boundary is created between the adjacent zones, hence forcing the wormholes to grow radially away from the wellbore.

Initially, before performing stimulation of the near-wellbore 1 simultaneously in adjacent zones 1, 2, 3 of the at least substantially annular space 4, acid or the like reactive fluid may be pumped into only the outermost zone 1 nearest the toe section, by opening the valve 14 of the internal pipe 9 corresponding to said zone 1 and closing the valves 15, 16 corresponding to the remaining zones 2, 3, until mud is at least substantially displaced from the entire internal pipe 9.

Said initial pumping of acid or the like reactive fluid into only the outermost zone 1 nearest the toe section may be performed at a pump rate that is at least substantially lower than, preferably lower than ½ of, more preferred lower than ¼ of, and most preferred lower than ⅙ of, the lowest pump rate during the subsequent stimulation.

In the case that acid or the like reactive fluid initially is pumped into only the outermost zone 1, stimulation may be initiated at least substantially simultaneously in all zones 1, 2, 3 of the at least substantially annular space 4, except for the outermost zone 1 nearest the toe section, by opening the respective valves 15, 16 in the other zones 2, 3 of the internal pipe 9 at least substantially simultaneously.

A desired reservoir pressure profile along the length of the wellbore 1 may be established, before stimulation is initiated, by pumping water through the internal pipe 9 into all zones 1, 2, 3 of the at least substantially annular space 4 between the non-cemented perforated liner and the formation.

FIG. 4*a* illustrates an embodiment of the method according to the invention, whereby, during stimulation of the near-wellbore 1, the pressure in different zones 1, 2, 3 of the at least substantially annular space 4 is controlled so that it increases from the toe section to the heel section. In this specific example, the pressure in zone 1 of the at least substantially annular space 4 is 1800 psia, the pressure in zone 2 is 2000 psia and the pressure in zone 3 is 2200 psia.

Although, according to the invention, it is generally aimed at reducing pressure differences between adjacent zones of the at least substantially annular space 4, specific conditions of the actual hydrocarbon reservoir may result in that a certain preferred pressure distribution over the different zones 1, 2, 3 may further improve zonal integrity during stimulation of the near-wellbore. The pressure differences between neighbouring zones should however be limited, and, generally according to the invention, preferably the absolute pressure in each zone does not differ more than 20%, more preferred less than 15%, and most preferred less than 10% from an average value.

Said certain preferred pressure distribution over the different zones 1, 2, 3 may be accomplished by designing the perforation scheme of the non-cemented perforated liner in accordance with information on zonal reservoir pressure and preferably in accordance with completion details of the wellbore. Furthermore, said certain preferred pressure distribution may be adapted by accordingly controlling the pumping rates of acid or the like reactive fluid and possibly water through the internal pipe 9 into the wellbore. Thereby, a no-flow boundary may be created in the reservoir between the zones 1, 2, 3 hence favouring strictly radial growth of the wormholes and consequently improving zonal integrity during stimulation of the near-wellbore.

FIG. 4*b* illustrates an embodiment of the method according to the invention, whereby, during stimulation of the near-wellbore 1, the pressure in different zones 1, 2, 3 of the at least substantially annular space 4 is controlled so that it decreases from the toe section to the heel section. In this specific example, the pressure in zone 1 of the at least substantially annular space 4 is 2200 psia, the pressure in zone 2 is 2000 psia and the pressure in zone 3 is 1800 psia.

Many other specific embodiments than those illustrated are possible. For instance, a certain preferred pressure distribution over the different zones 1, 2, 3 may be so that the pressure is slightly higher in the zones midway between the heel and the toe and so that the pressure is slightly lower in the zones at the heel and toe, respectively. The opposite is also possible, so that a certain preferred pressure distribution over the different zones 1, 2, 3 may be so that the pressure is slightly lower in the zones midway between the heel and the toe and so that the pressure is slightly higher in the zones at the heel and toe, respectively. In a further embodiment, the pressure may go slightly up and down several times along the length of the wellbore.

The non-cemented perforated liner may include a non-perforated section at one or both sides of each external packer in order to limit the volume of reactive fluid being injected into the formation very near to the packer, thereby further maintaining the zonal integrity during stimulation.

The acid concentration of the acid or the like reactive fluid versus the pump rate may be changed during stimulation. Thereby, the pressure profile and direction of wormhole growth around the packer may be further controlled.

It should be mentioned that in the context of this application, zonal integrity is intended to designate the isolation between each zone of the at least substantially annular space to prevent or at least limit the flow between the zones during injection or production. For some applications (high permeability reservoirs) packers may only be needed to hold a differential pressure of about 50 psia and still be effective, but for low permeability reservoirs with water injection, the packers may ideally be able to hold some 500 to 2500 psia. The latter may even not be possible and less may be sufficient. Via the reservoir there may always be some limited communication between the zones and eventually some fluid may flow from one zone to the other behind the packers, but this should preferably only be small volumes.

The invention claimed is:

1. A method for stimulation of a near-wellbore reservoir of a wellbore surrounded by a formation in a subterranean hydrocarbon reservoir, the wellbore having a horizontal section including a heel section and a toe section, the method comprising:

providing a non-cemented perforated liner in the horizontal section to thereby form a substantially annular space between the non-cemented perforated liner and the formation, wherein a perforation pattern of the non-cemented perforated liner is configured such that a total perforation hole area per unit length of the liner varies over the length of the liner from the heel to the toe;

arranging one or more external packers externally on the non-cemented perforated liner to thereby divide the substantially annular space between the non-cemented perforated liner and the formation into at least two zones isolated from each other, arranging an internal pipe and one or more internal packers corresponding to the one or more external packers inside the non-cemented perforated liner to thereby provide selective access to the at least two zones;

sealing a substantially annular space between the internal pipe and the non-cemented perforated liner;

for each of the at least two zones, arranging a valve on the internal pipe to facilitate access between the inside of the internal pipe and the corresponding zone through said substantially annular space between the internal pipe and the non-cemented perforated liner; and pumping reactive fluid simultaneously through the internal pipe and into at least two adjacent zones of the substantially annular space between the non-cemented perforated liner and the formation to thereby stimulate the near-wellbore, wherein configuring the perforation pattern so that the total perforation hole area per unit length of the liner varies over the length of the liner from the heel to the toe reduces pressure differences between said at least two adjacent zones that would otherwise occur during stimulation of the near-wellbore of the substantially annular space between the non-cemented perforated liner and the formation, wherein reduction of the pressure differences between said at least two adjacent zones reduces formation of worm holes in the formation between the at least two adjacent zones.

2. The method according to claim 1, whereby pressure differences occurring during stimulation of the near-wellbore between said at least two adjacent zones of the substantially annular space between the non-cemented perforated liner and the formation are reduced by accordingly controlling the pumping rates of reactive fluid through the internal pipe into the wellbore.

3. The method according to claim 1, whereby stimulation is initiated substantially simultaneously in all zones of the substantially annular space between the non-cemented perforated liner and the formation, by opening the valves of the internal pipe simultaneously.

4. The method according to claim 1, before stimulating the near-wellbore simultaneously in said at least two adjacent zones of the substantially annular space between the non-cemented perforated liner and the formation, pumping the reactive fluid into only one zone of the at least two zones at a time, by opening the valve of the internal pipe corresponding to said one zone and closing the valves corresponding to the remaining zones, until mud is displaced in its entirety from the internal pipe.

5. The method according to claim 4, further comprising initially pumping the reactive fluid into one zone at a time at an initial pump rate that is lower than ½ of an average pump rate during a subsequent stimulation.

6. The method according to claim 5, whereby the subsequent stimulation at said average pump rate is initiated substantially simultaneously in all zones of the substantially annular space between the non-cemented perforated liner and the formation by opening the valves of the internal pipe substantially simultaneously, after initially pumping the reactive fluid at said initial pump rate into said one zone at a time.

7. The method according to claim 4, further comprising initially pumping the reactive fluid into one zone at a time at an initial pump rate that is lower than ¼ of an average pump rate during a subsequent stimulation.

8. The method according to claim 4, further comprising initially pumping the reactive fluid into one zone at a time at an initial pump rate that is lower than ⅙ of an average pump rate during a subsequent stimulation.

9. The method according to claim 1, further comprising pumping water or a fluid of reduced reactivity compared to the reactive fluid through the internal pipe into all zones of the substantially annular space between the non-cemented perforated liner and the formation to thereby provide a desired reservoir pressure profile along the length of the wellbore before stimulation is initiated.

10. The method according to claim 1, whereby, during stimulation of the near-wellbore, the pressure in different zones of the substantially annular space between the non-cemented perforated liner and the formation is controlled so that it increases from the toe section to the heel section.

11. The method according to claim 1, whereby, during stimulation of the near-wellbore, the pressure in different zones of the substantially annular space between the non-cemented perforated liner and the formation is controlled so that it decreases from the toe section to the heel section.

12. The method according to claim 1, wherein the total perforation hole area per unit length for a part of the liner in a zone delimited by two packers increases from a minimum value at a first of said two packers to a maximum value at a second of said two packers further downhole.

13. The method of claim 12, wherein said perforation pattern repeats itself along the length of said liner for at least two adjacent zones.

14. The method according to claim 12, wherein the valves of the internal pipes are located at a region of each of the at least two zones closest to the heel section.

15. The method according to claim 12, wherein a valve of said zone delimited by two packers is located at one of said two packers with a valve of an adjacent zone also located at said one packer, said perforation pattern is configured such that the total perforation hole area per unit length for said adjacent zones increases from a respective minimum value at said one packer.

16. The method according to the claim 15, said respective minimum values are configured to have a variation of +/−10%.

17. The method of claim 15, said total perforation hole area per unit length increasing to a maximum value at an opposite end of the respective zone, such that the total perforation hole area per unit length increases away from said packer.

18. The method according to claim 1, wherein the total perforation hole area per unit length for a part of the liner in a second zone delimited by two packers increases from a minimum value at one of said two packers to a maximum value at the next one of said two packers further downhole, wherein the perforation pattern for a part of the liner in a first zone adjacent said second zone and closer to the toe section is selected such that the value of total perforation hole area per unit length of a region of the liner in the first zone nearest the second zone i) is within a range of 10% to 25% of said minimum value in said second zone.

19. The method according to claim 1, the valves of the internal pipe are placed about halfway along the length of zones in which the internal pipe is arranged.

20. The method according to claim 1 whereby pressure differences occurring during stimulation of the near-wellbore between the at least two adjacent zones of the substantially annular space between the non-cemented perforated liner and the formation are reduced by varying the total perforation hole area per unit length over the length of the liner.

* * * * *